US009011117B2

(12) United States Patent
Thut

(10) Patent No.: US 9,011,117 B2
(45) Date of Patent: Apr. 21, 2015

(54) PUMP FOR DELIVERING FLUX TO MOLTEN METAL THROUGH A SHAFT SLEEVE

(71) Applicant: Bruno H. Thut, Chagrin Falls, OH (US)

(72) Inventor: Bruno H. Thut, Chagrin Falls, OH (US)

( * ) Notice: Subject to any disclaimer, the term of this patent is extended or adjusted under 35 U.S.C. 154(b) by 133 days.

(21) Appl. No.: 13/916,704

(22) Filed: Jun. 13, 2013

(65) Prior Publication Data

US 2014/0369859 A1 Dec. 18, 2014

(51) Int. Cl.
*F04D 7/06* (2006.01)
*F27D 3/14* (2006.01)

(52) U.S. Cl.
CPC ..... *F04D 7/065* (2013.01); *F27D 3/145* (2013.01)

(58) Field of Classification Search
CPC ..... F04D 7/065
USPC ..... 417/423.3, 423.11, 423.14, 424.1; 266/236, 237, 239; 75/682, 683, 684
See application file for complete search history.

(56) References Cited

U.S. PATENT DOCUMENTS

| | | | | |
|---|---|---|---|---|
| 2,468,704 | A | 4/1949 | Pippin | |
| 4,169,584 | A * | 10/1979 | Mangalick | 266/214 |
| 4,351,514 | A | 9/1982 | Koch | |
| 4,931,091 | A | 6/1990 | Waite et al. | |
| 4,940,384 | A * | 7/1990 | Amra et al. | 415/121.2 |
| 4,954,167 | A | 9/1990 | Cooper | |
| 5,203,681 | A | 4/1993 | Cooper | |
| 5,676,520 | A | 10/1997 | Thut | |
| 5,678,807 | A | 10/1997 | Cooper | |
| 5,716,195 | A * | 2/1998 | Thut | 417/53 |
| 6,123,523 | A | 9/2000 | Cooper | |
| 6,187,096 | B1 * | 2/2001 | Thut | 118/300 |
| 6,217,632 | B1 | 4/2001 | Megy | |
| 6,524,066 | B2 * | 2/2003 | Thut | 415/200 |
| 6,689,310 | B1 | 2/2004 | Cooper | |
| 7,476,357 | B2 * | 1/2009 | Thut | 266/239 |
| 7,507,365 | B2 | 3/2009 | Thut | |
| 7,534,284 | B2 * | 5/2009 | Thut et al. | 75/684 |
| 7,669,739 | B2 | 3/2010 | Schmeisser | |
| 7,858,020 | B2 * | 12/2010 | Thut | 266/142 |

(Continued)

FOREIGN PATENT DOCUMENTS

| | | |
|---|---|---|
| KR | 100749026 | 8/2007 |
| KR | 20120082275 | 7/2012 |

(Continued)

OTHER PUBLICATIONS

Christoph Schmitz, et al., Handbook of Aluminum Recycling, Burwitz Feuerungsbau GmbH, Peine, Germany 2006, pp. 80-91.

(Continued)

*Primary Examiner* — Peter J Bertheaud
(74) *Attorney, Agent, or Firm* — Pearne & Gordon LLP

(57) ABSTRACT

A pump for pumping molten metal and delivering flux includes a refractory base that can be submerged in molten metal including an impeller chamber, an inlet and an outlet. A refractory shaft sleeve has upper and lower end portions and is fastened to the base at the lower end portion. A motor is disposed near the upper end portion of the shaft sleeve. A refractory shaft extends in the shaft sleeve and is connected to the motor near the upper end portion of the shaft sleeve. A refractory impeller is connected to the shaft and is rotatable in the impeller chamber. A flux feeding device feeds flux into the shaft sleeve. Also featured is a method for delivering flux in the shaft sleeve of the pump and a method for cleaning flux accretions in the shaft sleeve.

22 Claims, 4 Drawing Sheets

(56) References Cited

U.S. PATENT DOCUMENTS

| | | | | |
|---|---|---|---|---|
| 8,246,295 | B2 | 8/2012 | Morando | |
| 8,281,964 | B2 | 10/2012 | Schmeisser | |
| 2002/0148328 | A1 | 10/2002 | Holz et al. | |
| 2010/0104415 | A1 | 4/2010 | Morando | |
| 2011/0142606 | A1* | 6/2011 | Cooper | 415/200 |
| 2011/0163486 | A1 | 7/2011 | Cooper | |
| 2012/0163959 | A1 | 6/2012 | Morando | |

FOREIGN PATENT DOCUMENTS

| | | |
|---|---|---|
| WO | 2005103335 | 11/2005 |
| WO | 2011024290 | 3/2011 |

OTHER PUBLICATIONS

Brochure for Molten Metal Equipment Innovations SPEED DEMON Transfer Pump available on the internet at least as early as Jun. 13, 2013.

* cited by examiner

PUMP FOR DELIVERING FLUX TO MOLTEN METAL THROUGH A SHAFT SLEEVE

TECHNICAL FIELD

This disclosure pertains to a pump for pumping molten metal of the type used in a bath of molten metal leading to a furnace or hearth and to delivering flux used in the molten metal.

TECHNICAL BACKGROUND

Pumps for pumping molten metal of the type that include a motor driven impeller typically position the impeller on the end of a shaft inside an impeller chamber of an elongated base having an inlet and outlet from the impeller chamber. Upon rotation of the impeller, molten metal is drawn into the base into the impeller chamber and then travels to the outlet of the base. If the pump is a circulation or submerged discharge pump, the outlet of the base extends as a passageway to the outer surface of the base, which circulates the molten metal through a furnace or hearth, for example. If the pump is a transfer pump, the outlet can lead to a riser spaced apart from the shaft, which extends above the pump to a conduit which directs the molten metal to another location such as to a ladle or to a die casting machine. All of the components of the pump that are in the molten metal environment are typically made of refractory material such as graphite, ceramic, graphite with a ceramic covering or graphite impregnated with a refractory oxide.

Flux is typically added to molten metal circulating through the hearth or furnace by injecting the flux along with a gas stream through a lance operated by hand. The flux is used to clean the molten metal, for example, and is typically in particulate form. This process is cumbersome and hazardous to workers who have to be near the molten metal when operating the lance. Attempts to replace the hand lancing of flux addition by designing the pumps so as to receive the flux near the pump or inside the base have not been entirely successful. For example, flux conduits in which inert gas and particulate flux are injected through an inner passageway of the conduit having a passageway on the order of an inch or less in diameter are ineffective in that they routinely become clogged.

Pumps of the type that include a base have been designed with a refractory shaft sleeve that extends between the motor support plate and the base. The shaft rotates inside the sleeve. Gas has been added into the shaft sleeve as disclosed in U.S. Pat. No. 5,676,520, and displaced the molten metal therein. However, the longstanding problem of how to effectively introduce flux with a pump for pumping molten metal instead of the hand lancing process, remains unsolved.

BRIEF DESCRIPTION

A first embodiment of this disclosure generally features a pump for pumping molten metal and delivering flux including the following features. A refractory base can be submerged in molten metal and includes an impeller chamber, an inlet and an outlet. A refractory shaft sleeve has upper and lower end portions and is fastened to the base at the lower end portion. A motor is disposed near the upper end portion of the shaft sleeve. A refractory shaft extends in the shaft sleeve and is connected to the motor near the upper end portion of the shaft sleeve. A refractory impeller is connected to the shaft and is rotatable in the impeller chamber of the base. A flux feeding device feeds flux into the shaft sleeve (e.g., at or near the upper end portion of the shaft sleeve). Upon rotation of the impeller the flux can travel through the impeller chamber and from the outlet.

Referring now to specific features of the first embodiment, the shaft sleeve can be enclosed at the upper end portion thereof and a gas source is connected to the pump that flows gas into the shaft sleeve under pressure. The flux can be in a form of a particulate material. The gas from the gas source can be inert gas which travels from the flux feeding device, along with the particulate flux, into the shaft sleeve. The gas source can apply a pressure to molten metal inside the shaft sleeve to lower a level of the molten metal therein so that the flux travels in substantially only the gas through a portion of the shaft sleeve.

In one specific variation, the outlet can be a discharge passageway leading to an exterior surface of the base enabling the pump to circulate the molten metal and the flux through a vessel in which the base is submerged. In another specific variation, the outlet can communicate with a riser tube enabling the molten metal to be transferred to another location outside the vessel in which the base is submerged. Still further, the pump can be constructed and arranged to carry out circulation and/or transfer of the molten metal or the molten metal and the flux. For example, this can be achieved with the multifunctional Chameleon™ pump manufactured by High Temperature Systems, Inc., which can circulate, transfer, or both at the same time or different times and even transfer to multiple locations all with the same pump, as described in U.S. Pat. No. 7,507,365 which is incorporated herein by reference and is a pump suitable for use with the embodiments of this disclosure for delivering flux through the shaft sleeve.

Any of the features of the Detailed Description below can be combined with any of the specific features applicable to the first embodiment described above, in any combination.

A second embodiment of this disclosure features a method of delivering flux with a pump for pumping molten metal as described generally above. The method includes the following steps. The shaft is driven with the motor so as to rotate the impeller in the impeller chamber. The flux flows from the flux feeding device into the shaft sleeve (e.g., at or near the upper end portion of the shaft sleeve). The flux can travel down the shaft sleeve through the action of one or more of force of gravity on the flux, entrainment of flux by gas flowing into the shaft sleeve or dropping the flux through the gas atmosphere in the shaft sleeve, and action caused by rotation of the impeller in molten metal in the base. Rotation of the impeller can cause the flux to travel through the impeller chamber and from the outlet.

As for specific features that apply to the second embodiment, if the gas source is used, the gas flows from the gas source into the shaft sleeve under pressure. This can lower a level of the molten metal in the shaft sleeve compared to when the pressurized gas is not applied. The gas from the gas source can be inert gas, comprising flowing the inert gas from the flux feeding device, along with particulate flux, into the shaft sleeve. The gas source can supply the gas at a pressure to molten metal inside the shaft sleeve that lowers a level of the molten metal therein so that the flux travels in substantially only the gas through a portion of the shaft sleeve.

Still further, the outlet can be a discharge passageway leading to an exterior surface of the base and the method can comprise rotating the impeller to circulate the molten metal and the flux through a vessel in which the base is submerged. In another variation, the outlet can communicate with a riser tube and the method can comprise passing the molten metal from the outlet, through the riser tube and then to another location outside of the vessel in which the base is submerged. In yet another variation, the pump can carry out one or more of circulating, transferring, and circulating and transferring the molten metal, or the molten metal and the flux. The flux feeding device may feed flux alone, or flux and gas, into the shaft sleeve.

Any of the features described above in connection with the first embodiment, and features of the Detailed Description below, can apply to the specific features applicable to the second embodiment described above, in any combination.

In a third embodiment, the method features cleaning the pump by carrying out at least one of the following steps: reducing the flow of gas, stopping the flow of gas, stopping the flow of gas and imposing a vacuum inside the shaft sleeve, and increasing the speed of the motor, which causes the molten metal to rise inside the shaft sleeve into contact with accretions deposited from the flux. This contact may remove the accretions and clean the pump. The impeller may be rotated (or not) during the cleaning.

It should be understood that the above Brief Description describes embodiments of the disclosure in broad terms while the following Detailed Description describes embodiments of the disclosure more narrowly and presents specific embodiments that should not be construed as necessary limitations of the invention as broadly defined in the claims. Many additional features, advantages and a fuller understanding of the invention will be had from the accompanying drawings and the Detailed Description that follows.

DETAILED DESCRIPTION

Figure 1:
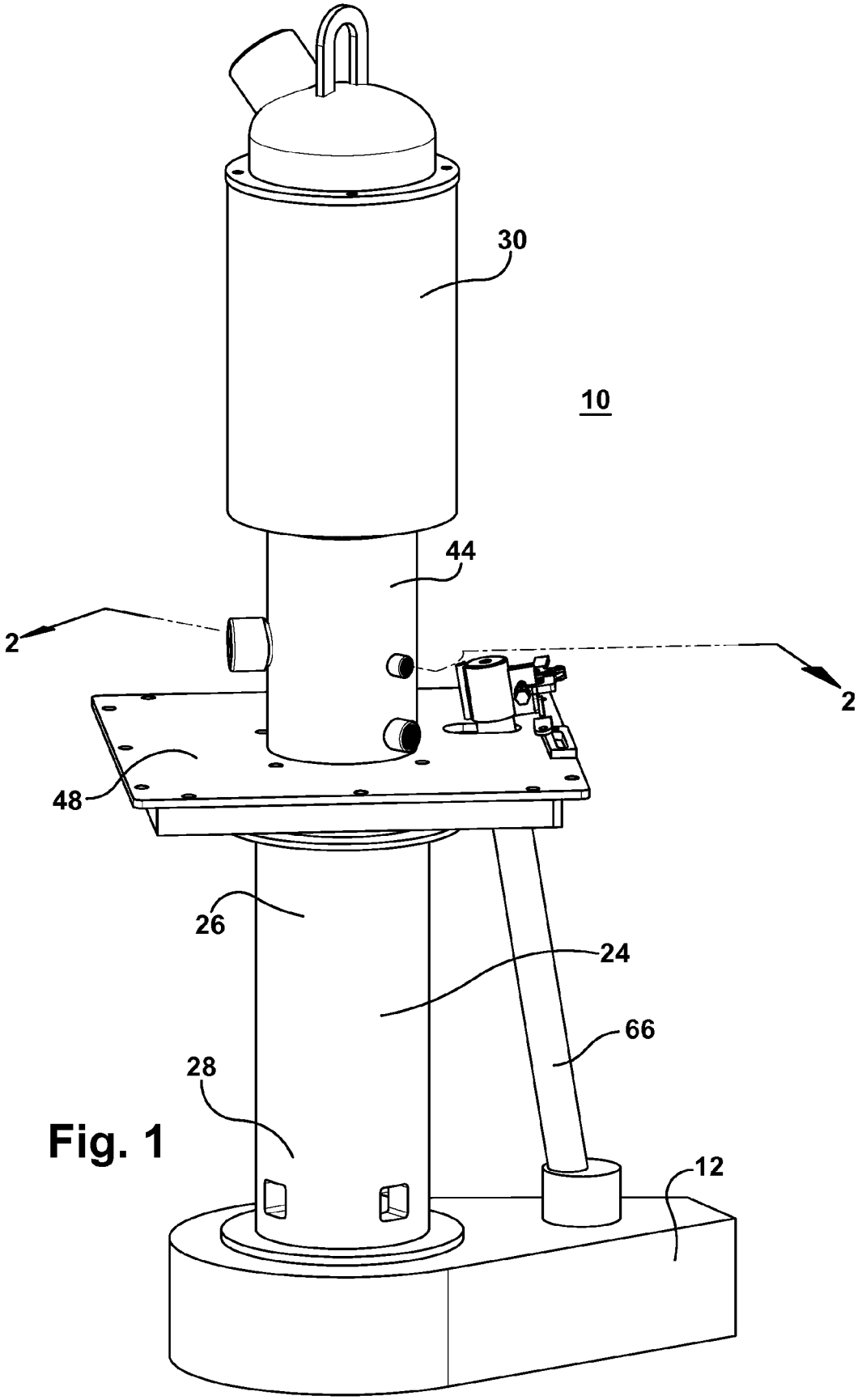
FIG. 1 is a perspective view of an example of a pump according to this disclosure.

The pump 10 for pumping molten metal and delivering flux includes the following features. A base 12 is submerged in a bath of molten metal 14 contained in a vessel 16 and includes an impeller chamber 18, an inlet 20 and an outlet 22. A refractory shaft sleeve 24 has upper and lower end portions 26, 28, respectively, and is fastened to the base 12 at its lower end portion 28. The shaft sleeve is in the form of a hollow cylinder or tube having a central passageway through it. A motor 30 (e.g., air or electric motor) is disposed near the upper end portion 26 of the shaft sleeve 24. A refractory shaft 32 extends in the shaft sleeve 24 and is connected to the motor near the upper end portion 26 of the shaft sleeve. A refractory impeller 34 is connected to the refractory shaft 32 and is rotatable in the impeller chamber 18 of the base 12. The shaft sleeve 24 is enclosed at the upper end portion 26 thereof as will be described below. A gas source 36 (e.g., a tank of pressurized inert gas) is connected to or near the upper end portion of the shaft sleeve and flows gas into the shaft sleeve 24 under pressure. An optional gas source 38 (e.g., a tank of pressurized inert gas) may also be used. Conduit 40*a*, 40*b* leads from each gas source, respectively, to upper tube or hollow member 44 of the pump. A flux feeding device 42 feeds flux into the upper tube 44 and then down into the shaft sleeve 24. The conduit 40*a* extends from the gas source 36 to the flux feeding device 42 while conduit 40*c* extends from the flux feeding device to the upper tube 44 of the pump. It should be appreciated that the gas may not need to travel through the flux feeding device 42 and instead may just contact the flux leaving the device. Upon rotation of the impeller the flux 46 travels down the shaft sleeve into the impeller chamber 18 and from the outlet 22.

Figure 2:
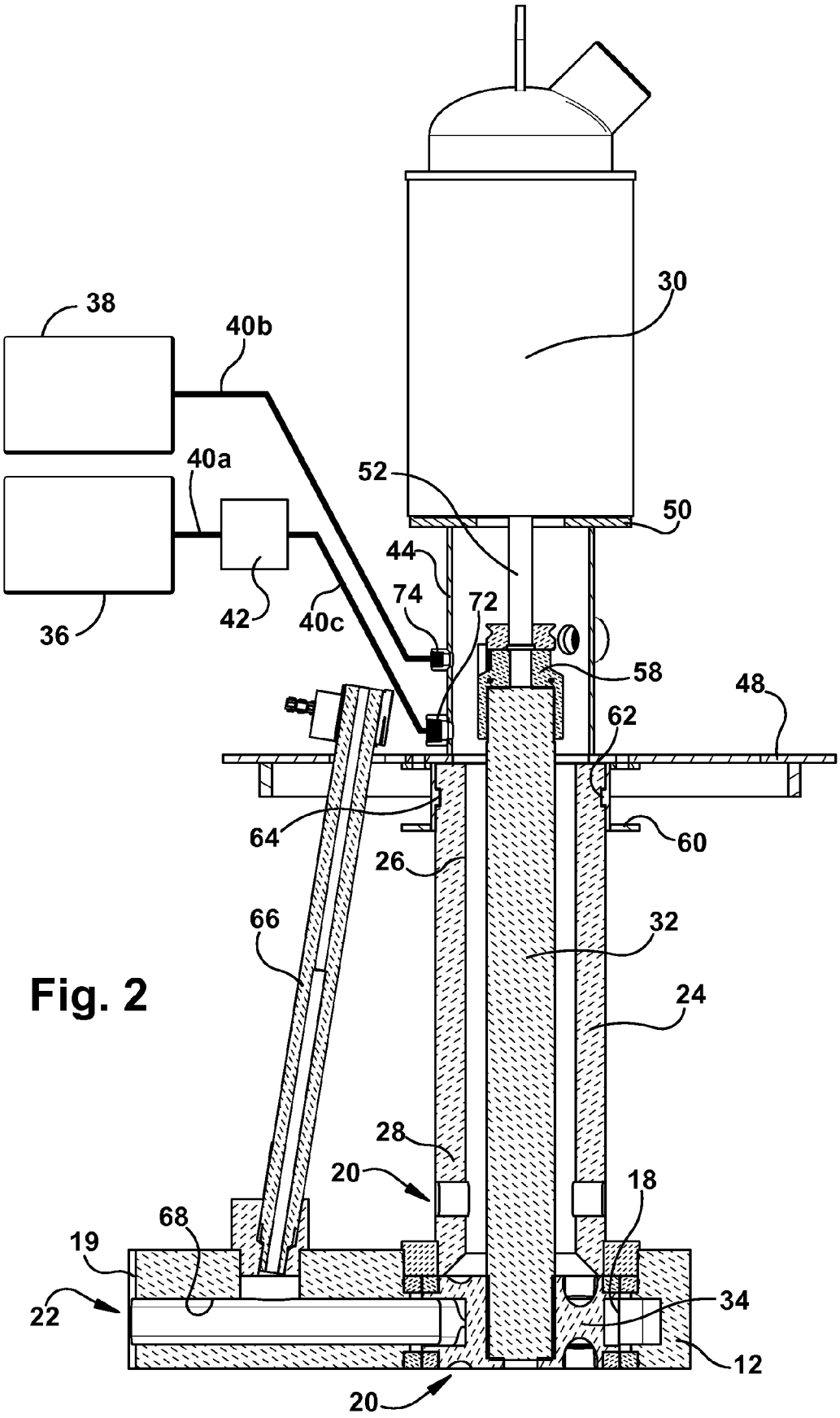
FIG. 2 is a vertical cross-sectional view of the pump of FIG. 1.
Figure 3:
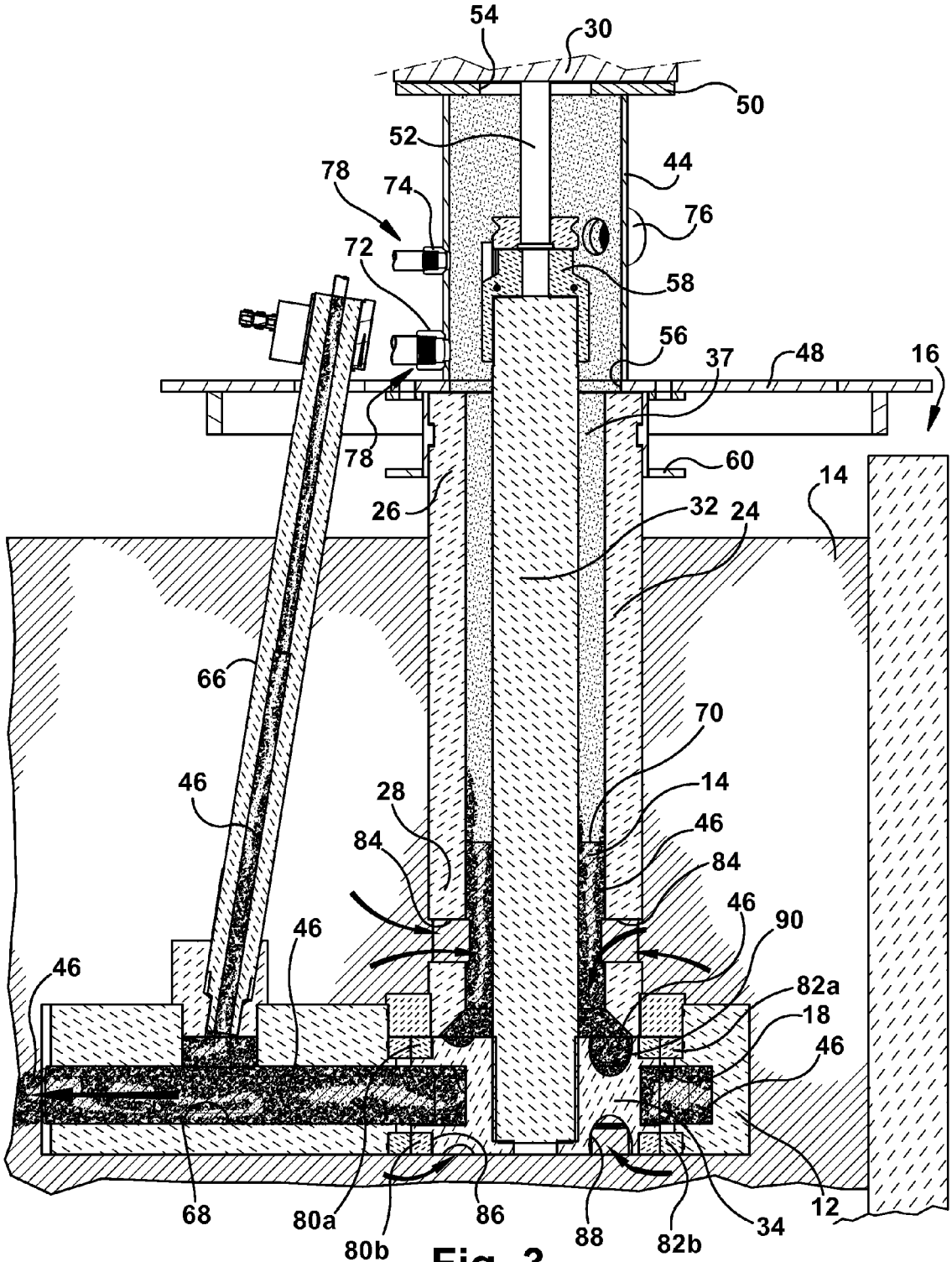
FIG. 3 is a vertical cross-sectional view showing the pump operating with the use of gas under pressure in the shaft sleeve and delivery of flux into the shaft sleeve.

The pump includes a motor mount base plate 48. A motor adapter plate 50 is spaced above the motor mount base plate 48. The upper tube 44 extends between the motor mount base plate 48 and the motor adapter plate 50. The motor mount base plate 48, the motor adapter plate 50 and the upper tube 44 can be composed of metal, for example, steel, and can be fastened together in a known manner such as by welding. The motor 30 is affixed on the adapter plate 50. A drive shaft 52 of the motor 30 extends into an opening 54 in the motor adapter plate 50. The opening 54 is aligned with an opening 56 in the motor mount base plate 48 (FIG. 3). A coupling 58 as is known in the art and shown only generally in the drawings, connects the motor drive shaft 52 and the pump shaft 32 together and is disposed in the upper tube 44. A metal quick disconnect member 60 is fastened to the bottom of the motor mount base plate 48 and includes a protrusion 62 that engages a slot 64 in the shaft sleeve (FIG. 2) in a manner known in the art. Thus, the member 60, when fastened to the bottom of the motor mount base plate, releasably grips the shaft sleeve. The member 60 is fastened to the motor mount base plate and the two sections of the member are fastened together, using fasteners. The lower end portion 28 of the shaft sleeve 24 is fastened near an upper surface of the base such as using cement. An optional gas and/or gas and flux injection tube 66 known in the art may extend between the motor mount base plate 48 and the base 12 in communication with a discharge passageway 68 of the base (FIG. 2) in the example pump shown.

The flux feeding device 42 known in the art feeds flux and optionally gas into the upper tube 44, such as using a screw feed in the flux feeding device. The gas may contact the flux as the flux leaves the flux feeding device so as to entrain the flux along the conduit. The flux feeding device 42 can sit on the floor outside the furnace. The upper tube 44 is disposed above the refractory shaft sleeve 24. The upper tube 44, the motor mount base plate 48, the motor adapter plate 50 and the motor 30 form an enclosure about the upper end portion 26 of the shaft sleeve 24 (i.e., its circular passageway at its upper end portion) so that it can be pressurized. The gas source 36 (and/or 38) can apply pressure to the molten metal 14 inside the shaft sleeve 24 to lower a level 70 of the molten metal inside it so that the flux 46 travels in substantially only the gas through a portion of the shaft sleeve (FIG. 3). The molten metal level 70 in the shaft sleeve will be above the inlet openings 84 of the shaft sleeve at a location which does not result in cavitation of the pump. The upper tube 44 can include a first port 72, and optional second port 74 and third port 76. The gas travels from the gas source 36 and the particulate flux 46 from the flux feeding device 42 and the gas travel together along the conduit 40*c* from the flux feeding device into the upper tube 44. The conduits 40*c*, 40*b* can be fastened to the respective first and second ports 72, 74, respectively, via a fitting shown generally at 78 in FIG. 3 (e.g., a threaded connection between the conduit and port). The view of the pump operating in FIG. 3 may be after flux flow has been shut off but while the gas flow continues and while the motor is operating. This illustrates how the pump can maintain the pressure inside the shaft sleeve by applying only gas and to periodically combine this with flux charging when desired. The pump can be operated by applying gas continuously or not.

Any molten metal can be processed according to the present disclosure but particular examples are aluminum, magnesium and zinc. A variety of fluxes 46 having different chemistries and physical properties can be employed depending on the metal that is treated and the function of the flux. The flux 46 can be in any form, for example as a solid, and specifically is in a form of a particulate material. Examples of flux 46 can be found in Ch. Schmitz, Handbook of Aluminum Recycling, 2006, which is incorporated herein by reference in its entirety. In particular, the flux feeding device 42 feeds inert gas 37 and particulate flux 46 into the upper tube 44. Alternatively, it is possible to flow only gas 37 into the conduit 40*a*, 40*c* and/or the conduit 40*b* and into the upper tube 44. The gas 37 that flows into the second port 74 can replace or supplement the gas 37, or the gas 37 and the flux 46, traveling into the first port 72. The gas 37 only, the gas 37 and the flux 46, or the flux 46 only, travels from the upper tube 44 down into the shaft sleeve 24. The gas 37 can be any suitable gas, for example, inert gas such as nitrogen or argon. A suitable gas pressure can be 0 to 5 psi, for example, and in particular, from 1 to 5 psi, for molten aluminum. Pressures higher than 5 psi may be used when pressurizing the shaft sleeve in connection with molten metal such as zinc having a higher density than molten aluminum. The gas pressure may also be affected by how deep the pump is immersed in the molten metal. The upper tube 44 may include one or more closable windows or third ports 76, which when opened, can permit one to access the coupling with tools.

In one specific variation shown in the drawings, the outlet 22 includes the discharge passageway 68 leading from the impeller chamber 18 to an exterior surface 19 of the base enabling the pump to circulate the molten metal 14 and the flux 46 through a vessel. However, in another specific variation, the outlet 22 can communicate with a riser tube enabling the molten metal to be transferred to another location. For example, the base is submerged in a vessel, such as a pump well, that communicates with a furnace. Still further, the pump can be constructed and arranged to carry out circulation, transfer, and/or circulation and transfer of the molten metal or the molten metal 14 and the flux 46. For example, this can be achieved with the multifunctional Chameleon® pump manufactured by High Temperature Systems, Inc., which can circulate, transfer, or both at the same time or different times and even transfer to multiple locations all with the same pump, which is incorporated herein by reference and is a pump suitable for modification so as utilize the embodiments of this disclosure for delivering flux through the shaft sleeve 24.

A method of delivering flux 46 through the shaft sleeve 24 of the molten metal pump 10 includes the following steps. The shaft 32 is driven by operating the motor 30 so as to rotate the impeller 34 in the impeller chamber 18. The optional gas 37 flows from the gas source (36 and/or 38) into the shaft sleeve 24 under pressure so as to lower a level 70 of the molten metal 14 in the shaft sleeve 24. The flux 46 flows from the flux feeding device into the shaft sleeve 24 alone or with gas. Rotation of the impeller 34 causes the molten metal to move the flux 46 so as to travel from inside the shaft sleeve into the impeller chamber 18 and from the outlet 22 into the molten metal bath in which the base 12 is submerged in vessel 16.

In another variation the outlet communicates with a riser tube, and the molten metal is passed from the outlet, through the riser tube and then to another location. The pump can carry out one or more of circulating, transferring, and circulating and transferring, the molten metal or the molten metal and the flux, using the pump. The flux feeding device 42 can feed flux 46 alone, or flux 46 and gas 37, into the shaft sleeve 24. Gas 37 alone can also flow into the shaft sleeve 24 without flux 46, using the same gas source 36 as is used to flow the gas 37 along with the flux 46 (when the flux feeding is turned off).

The gas source 36 and/or 38 is connected to the pump and flows gas into the upper tube 44 and the shaft sleeve 24 under pressure. This pressurizing occurs because the upper open end of the shaft sleeve is enclosed. The pump shaft 32 is driven with the motor so as to rotate the impeller 34 in the impeller chamber 18. Upper and lower bearing rings 80*a*, 80*b*, respectively, on the impeller 34 are disposed to rotate inside upper and lower bearing rings 82*a*, 82*b*, respectively, fastened to the base 12 (FIG. 3). These bearing rings may be formed of abrasion resistant ceramic as known in the art. The engagement of the bearing rings 80*a*, 82*a* and 80*b*, 82*b*, centers the impeller 34 for rotation inside the impeller chamber 18. Near the lower end portion 28 of the shaft sleeve 24 are inlet openings 84 through which the molten metal 14 enters the base 12. The molten metal 14 is moved into the inlet openings 84 of the shaft sleeve 24 into the base and impeller chamber 18 as shown by the arrows in FIG. 3, and then through the outlet 22, shown in the discharge pump of FIG. 3, as a discharge passageway 68 that leads to an exterior surface 19 of the base, as a result of the rotation of the impeller 34 in the impeller chamber 18.

The impeller 34 may be a top feed, bottom feed or top and bottom feed impeller as known in the art. In the example top and bottom feed impeller (FIG. 3), the molten metal also enters the impeller chamber through passages in the bottom of the impeller, the impeller being situated so as to block a lower opening 86 in the base. The lower bearing ring 82*b* fastened to the base can be disposed so as to delimit the lower opening 86. The impeller 34 is positioned so as to block the lower opening 86 and so that molten metal enters the impeller chamber through the lower openings 88 in the impeller. The impeller also includes upper impeller openings 90 as is known in the art for a top and bottom feed impeller by High Temperature Systems, Inc. The impeller chamber 18 may include a volute member or be formed in a shape of a volute, or not, as known in the art. The submerged discharge pump example shown in the drawings is operated to circulate the molten metal from the bath of molten metal in which the pump is situated, through a furnace.

The gas 37 flows into the upper tube 44 and the shaft sleeve 24 at a pressure which lowers a height 70 of the molten metal 14 in the shaft sleeve above the inlet openings 84. That is, the pressurized gas forces the molten metal lower 14 in the shaft sleeve than it would ordinarily be while the motor is operating (and even while the motor is off). The gas may enter through the first port 72 and/or the second port 74 of the upper tube 44 or elsewhere in the pump in a variation of the pump design shown in the drawings. For example, the gas 37 and/or flux 46 might be fed directly into the refractory shaft sleeve 24 using suitable heat resistant conduit between the gas source(s) 36 and 38 and shaft sleeve 24 and/or the flux feeding device 42 and upper tube 44 (or the shaft sleeve 24).

The pressurized gas 37 inside the shaft sleeve 24 may keep it cleaner than if molten metal occupied a greater height in the shaft sleeve. The pressurized gas may also facilitate delivering the flux 46 into the pump better than without gas in the shaft sleeve. Without gas in the shaft sleeve, the flux would travel through more molten metal in the shaft sleeve.

Gas alone, the flux alone or the flux and gas together, may also be delivered along the flux feeding tube 66 extending between the motor mount and the base in communication with the discharge passageway as shown in FIG. 3 and known in the art.

Figure 4:
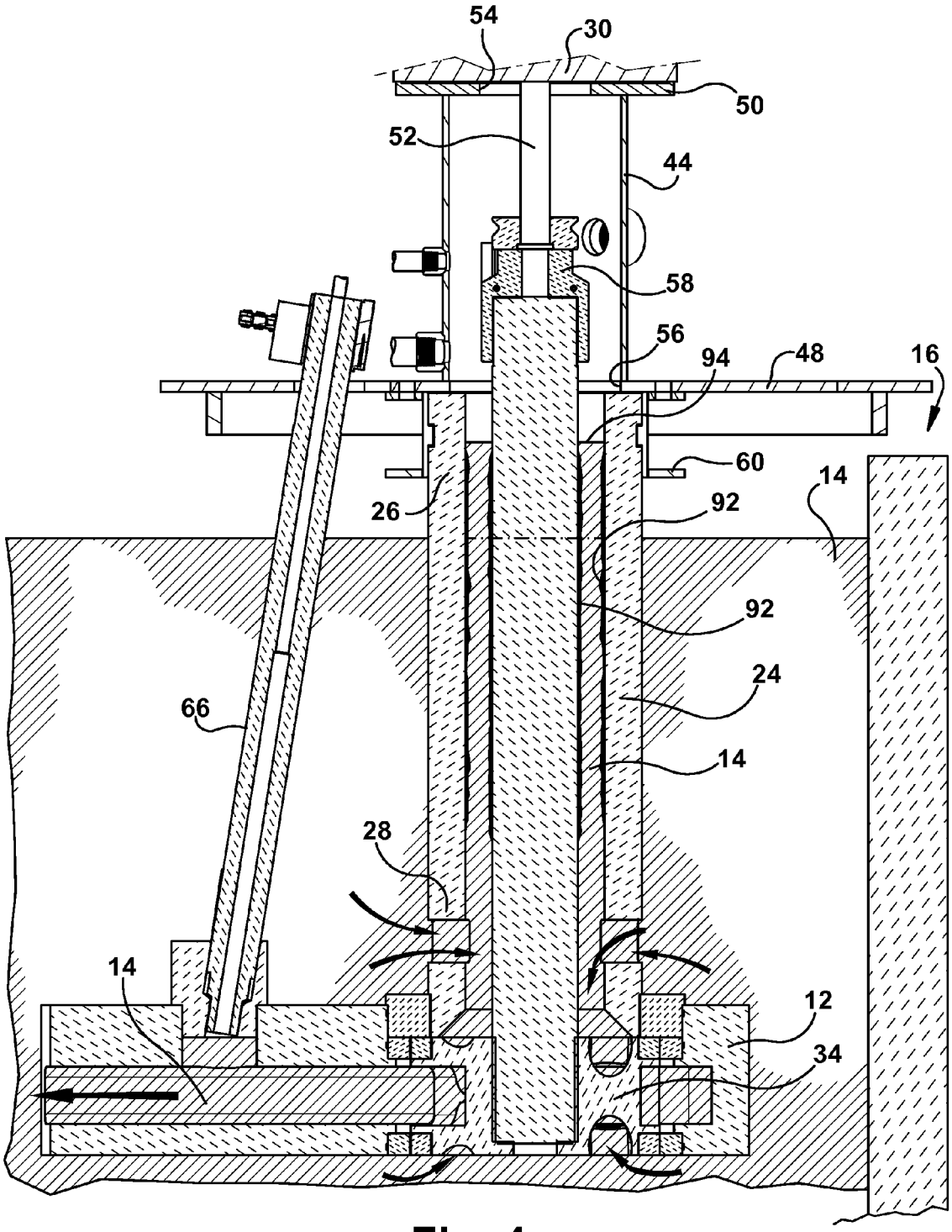
FIG. 4 is a cleaning step in which the pump is operated without the gas flow inside the shaft sleeve, causing the molten metal level to rise inside the shaft sleeve, so as to clean flux accretions.

Referring to FIG. 4, when cleaning flux accretions 92 on the inside of the shaft sleeve 24 and/or on the outside of the refractory shaft 32, at least one of the following steps is carried out: reducing the flow of gas, stopping the flow of gas, stopping the flow of gas and imposing a vacuum inside the shaft sleeve, and increasing the speed of the motor, which causes molten metal to rise inside the shaft sleeve into contact with the flux accretions. The flux accretions are expected to result from deposit of the flux. It is believed that this contact of the molten metal and the flux accretions will remove the flux accretions and clean the pump. The impeller may be rotated (or not) during the cleaning. The cleaning operation shown in FIG. 4 depicts cleaning when the motor is operating, which continually removes the molten metal after it contacts the flux accretions 92 while the gas supply has been turned off. The molten metal level 94 during cleaning (FIG. 4) is higher than the molten metal level 70 during normal pump operation (FIG. 3), both molten metal levels being approximations.

This cleaning process might also be conducted without operating the motor. That is, simply stopping the flow of gas 37 even without operating the motor may cause the molten metal level to rise sufficiently high in the shaft sleeve so as to clean the accretions. This molten metal height inside the shaft sleeve may be increased by operating the motor at normal, or higher than normal, speed. Operating the motor to run faster so as to increase the molten metal height in the shaft sleeve might also be carried out while the gas still flows (e.g., at normal gas pressure during ordinary pumping operation or below this normal gas pressure), or while the gas flow is shut off. Also pulling a vacuum on the shaft sleeve (i.e., through one or more of the ports on the upper tube or through one port while closing the other ports) will increase the molten metal height in the shaft sleeve. This contact of the molten metal with the flux accretions is expected to remove the accretions and clean the pump. Care should be taken in this cleaning method to avoid overflow into the coupling or motor.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A pump for pumping molten metal and delivering flux comprising:

a refractory base that can be submerged in molten metal including an impeller chamber, an inlet and an outlet;

a refractory shaft sleeve having upper and lower end portions and being fastened to said base at the lower end portion;

a motor disposed near the upper end portion of said shaft sleeve;

a refractory shaft extending in said shaft sleeve and connected to said motor near the upper end portion of said shaft sleeve;

a refractory impeller connected to said shaft and rotatable in said impeller chamber of said base; and a flux feeding device that feeds flux into said shaft sleeve.

2. The pump of claim 1 wherein said shaft sleeve is enclosed at the upper end portion thereof, comprising a gas source connected at or near the upper end portion of said shaft sleeve that flows gas into said shaft sleeve under pressure.

3. The pump of claim 1 wherein said flux is in a form of a particulate material.

4. The pump of claim 2 wherein said gas from said gas source is inert gas which travels from said flux feeding device, along with particulate said flux, into said shaft sleeve.

5. The pump of claim 4 wherein said gas source applies a pressure to molten metal inside said shaft sleeve to lower a level of the molten metal therein so that said flux travels in substantially only said inert gas through a portion of said shaft sleeve.

6. The pump of claim 1 wherein said outlet is a discharge passageway leading to an exterior surface of said base enabling said pump to circulate the molten metal and said flux through a vessel in which said base is submerged.

7. The pump of claim 1 wherein said outlet communicates with a riser tube enabling the molten metal to be transferred to another location.

8. The pump of claim 1 wherein said pump is constructed and arranged to carry out at least one of circulation, transfer, and circulation and transfer of the molten metal or the molten metal and said flux.

9. The pump of claim 1 wherein said impeller is a top and bottom feed impeller.

10. The pump of claim 1 wherein said inlet includes inlet openings in said shaft sleeve.

11. The pump of claim 9 wherein said inlet includes inlet openings in said shaft sleeve and an opening in a bottom of said base that is blocked so that the molten metal enters said impeller chamber through openings in said impeller.

12. A method of delivering flux with a pump for pumping molten metal comprising:

providing the pump of claim 1;

driving said shaft with said motor so as to rotate said impeller in said impeller chamber; and flowing said flux from said flux feeding device into said shaft sleeve.

13. The method of claim 12 wherein said shaft sleeve is enclosed at the upper end portion thereof, comprising a gas source connected to said pump at or near the upper end portion of said shaft sleeve, flowing the gas from said gas source into said shaft sleeve under pressure.

14. The method of claim 12 wherein said flux is in a form of a particulate material.

15. The method of claim 13 wherein said gas from said gas source is inert gas, comprising flowing said inert gas from said flux feeding device, along with particulate said flux, into said shaft sleeve.

16. The method of claim 15 wherein said gas source applies a pressure to molten metal inside said shaft sleeve to lower a level of the molten metal therein so that said flux travels in substantially only said inert gas through a portion of said shaft sleeve.

17. The method of claim 12 wherein said outlet is a discharge passageway leading to an exterior surface of said base, comprising rotating said impeller to circulate the molten metal and said flux through a vessel in which said base is submerged.

18. The method of claim 12 wherein said outlet communicates with a riser tube, comprising passing the molten metal from said outlet, through said riser tube and then to another location.

19. The method of claim 12 wherein said pump is constructed and arranged to carry out one or more of circulation, transfer, and circulation and transfer of the molten metal or the molten metal and said flux, comprising carrying out one or more of circulating, transferring, and circulating and transferring the molten metal or the molten metal and said flux, using said pump.

20. The method of claim 13 wherein said flux feeding device feeds flux alone or flux and gas into said shaft sleeve.

21. The method of claim 12 including cleaning said pump by carrying out at least one of the following: reducing the flow of gas, stopping the flow of gas, stopping the flow of gas and imposing a vacuum inside said shaft sleeve, and increasing the speed of the motor, which causes the molten metal to rise inside said shaft sleeve into contact with accretions deposited from the flux, said contact removing the accretions and cleaning the pump.

22. The method of claim 21 wherein said impeller is rotated during said cleaning.

* * * * *